US008875899B2

(12) United States Patent
Young

(10) Patent No.: US 8,875,899 B2
(45) Date of Patent: Nov. 4, 2014

(54) PUMPBOX

(75) Inventor: Michael Francis Young, Brisbane (AU)

(73) Assignee: Xstrata Technology Pty. Ltd., Brisbane (AU)

( * ) Notice: Subject to any disclaimer, the term of this patent is extended or adjusted under 35 U.S.C. 154(b) by 1212 days.

(21) Appl. No.: 12/761,753

(22) Filed: Apr. 16, 2010

(65) Prior Publication Data

US 2010/0263752 A1 Oct. 21, 2010

(30) Foreign Application Priority Data

Apr. 17, 2009 (AU) ..... 2009901647

(51) Int. Cl.

| | |
|---|---|
| ***B03D 1/14*** | (2006.01) |
| ***F04B 23/02*** | (2006.01) |
| ***B03B 13/00*** | (2006.01) |
| ***B03D 1/02*** | (2006.01) |

(52) U.S. Cl.

CPC ..... *F04B 23/02* (2013.01); *B03D 1/1456* (2013.01); *B03D 1/14* (2013.01); *B03B 13/00* (2013.01); *B03D 1/028* (2013.01); *B03D 1/1468* (2013.01)

USPC ..... 209/168; 209/18; 137/391; 137/395; 137/399; 137/577; 210/109; 210/143; 210/221.2

(58) Field of Classification Search

CPC ..... B03D 1/1468; B03D 1/1475; B03D 1/247

USPC ..... 209/164, 168, 18; 137/391, 395, 399, 137/577; 210/109, 143, 221.2

See application file for complete search history.

(56) References Cited

U.S. PATENT DOCUMENTS

| | | | | |
|---|---|---|---|---|
| 5,188,726 | A | 2/1993 | Jameson | |
| 5,672,267 | A | 9/1997 | Terblanche | |
| 2011/0174696 | A1* | 7/2011 | Young et al. | 209/18 |
| 2013/0284642 | A1* | 10/2013 | Teague | 209/3.1 |

FOREIGN PATENT DOCUMENTS

| | | | |
|---|---|---|---|
| AU | 755909 | B2 | 12/1998 |
| AU | 199873124 | B2 | 12/1998 |

* cited by examiner

*Primary Examiner* — Thomas M Lithgow

(74) *Attorney, Agent, or Firm* — Ungaretti & Harris LLP

(57) ABSTRACT

A pumpbox, the pumpbox being in fluid communication with one or more vessels, wherein the pumpbox comprises a classification portion and level control means adapted to control the level of fluid within the one or more vessels.

17 Claims, 2 Drawing Sheets

PUMPBOX

CROSS-REFERENCE TO RELATED APPLICATIONS

This application claims priority under 35 U.S.C. §119 to Australian Patent Application No. 2009901647, filed Apr. 17, 2009, the disclosure of which is incorporated herein by reference.

FEDERALLY SPONSORED RESEARCH OR DEVELOPMENT

N/A

TECHNICAL FIELD

The present invention relates to a pumpbox. In particular, the present invention relates to a pumpbox adapted to control the fluid level in a vessel with which the pumpbox is associated.

BACKGROUND OF THE INVENTION

Pumpboxes are widely used in many industrial and metallurgical applications. Typically, material such as suspensions or slurries enters the pumpbox from where it is transferred to another part of a processing plant. Conventional pumpboxes typically comprise a vessel in communication with a pump which operates continuously or semi-continuously to pump material away from the vessel.

In some industrial processes, such as froth flotation plants, pumpboxes are often associated with equipment such as flotation cells. In many conventional flotation plants, tails streams from one or more cells (or banks of cells) are sent to a pumpbox from where the stream is pumped to another part of the plant or to tailings dams or the like.

In flotation cells, maintaining a constant fluid level in the cell is crucial in order to achieve smooth and consistent operation of the process, and the highest possible recovery of valuable mineral. Typically, the control of the fluid level is achieved within the flotation cell itself. However, locating level control mechanisms within a flotation cell tends to create problems with wear and maintenance.

Thus, there would be an advantage if it were possible to provide a pumpbox that provided means for controlling the fluid level in an associated flotation cell. In addition, there would be an advantage if the pumpbox also provided means for classifying the stream exiting the flotation cell and entering the pumpbox.

It will be clearly understood that, if a prior art publication is referred to herein, this reference does not constitute an admission that the publication forms part of the common general knowledge in the art in Australia or in any other country.

Throughout this specification, the term "comprising" and its grammatical equivalents shall be taken to have an inclusive meaning unless the context of use indicates otherwise.

The present invention is provided to solve the problems discussed above and other problems, and to provide advantages and aspects not provided by prior pumpboxes of this type. A full discussion of the features and advantages of the present invention is deferred to the following detailed description, which proceeds with reference to the accompanying drawings.

SUMMARY OF THE INVENTION

It is an object of the present invention to provide a pumpbox which may overcome at least some of the abovementioned disadvantages, or provide a useful or commercial choice.

In a first aspect, the invention resides broadly in a pumpbox, the pumpbox being in fluid communication with one or more vessels, wherein the pumpbox comprises a classification portion and level control means adapted to control the level of fluid within the one or more vessels.

The pumpbox may be of any suitable form. For instance, in some embodiments of the invention the pumpbox may comprise a single chamber. In other embodiments of the invention, the pumpbox may comprise a plurality of chambers in fluid communication with one another.

In embodiments of the invention in which the pumpbox comprises a plurality of chambers, the plurality of chambers may be for any suitable purpose. For instance, one chamber may house the classification portion of the pumpbox. Further chambers may be provided for processing or disposal of the classification products, the level control means or the like. In a preferred embodiment of the invention, the pumpbox comprises three chambers in fluid communication with one another.

The one or more vessels with which the pumpbox is in fluid communication may be of any suitable type. For instance, the one or more vessels may be a mixing tank, settling vessel, or any other vessel in which it is necessary or advantageous to control the level of fluid. In a preferred embodiment of the invention, the one or more vessels may be a flotation cell, or a bank of flotation cells. Any suitable flotation cell may be used in conjunction with the pumpbox of the present invention, such as a mechanical flotation cell, pneumatic flotation cell or the like, or a combination of cells. In a most preferred embodiment of the invention, the flotation cell may be a Jameson cell.

Any suitable stream of fluid may be fed from the one or more vessels to the pumpbox. For instance, when the one or more vessels comprise flotation cells, it may be that the tailings stream from the flotation cell is fed to the pumpbox.

The stream may be fed to the pumpbox using any suitable technique, although in a preferred embodiment of the invention, the stream may be fed to the pumpbox under gravity.

The pumpbox and the one or more vessels may be formed as a single vessel that is divided into the vessel section and the pumpbox section. Alternatively, the pumpbox and the one or more vessels may be formed as separate vessels that are in fluid communication with one another.

The classification portion of the pumpbox may be of any suitable form and may classify the stream entering the pumpbox using any suitable technique or any suitable property of the stream. For instance, the classification portion may comprise an additional piece of equipment (such as a hydrocyclone, magnetic separator or the like, or any combination thereof). Alternatively, the classification portion may classify the stream on the basis of differences in the properties of the constituent elements of the stream, such as density, particle size, buoyancy and so on, or any combination thereof.

In embodiments of the invention in which the stream entering the pumpbox is a slurry (i.e. solid particles carried in a liquid medium), it may be preferred that the classification is carried out on the basis of differences in the properties of the solid particles. For instance, the particles may be classified on the basis of their size (such as by screening the particles) or on the basis of their density. In embodiments of the invention in which the particles are classified on the basis of their size and/or density, a hydrocyclone (or similar piece of equipment) may be used. Alternatively, the particles may be classified using gravity. For instance, the particles may be classified on the basis of their settling velocity wherein the larger, denser particles sink with a greater velocity than the finer, lighter particles. Alternatively, the fluid stream may be subjected to a change of direction upon entering the pumpbox such that finer, lighter particles continue to be carried by the fluid stream, while the change in fluid momentum caused by the change in direction causes the larger, denser particles to drop out of the stream.

In some embodiments of the invention, the stream entering the classification portion of the pumpbox may be classified into two or more streams.

The level control means may be of any suitable form provided that the fluid level in the one or more vessels may be controlled by actuation of the level control means. In a preferred embodiment of the invention, the level control means comprises one or more fluid control devices that control the volume of fluid or the flowrate of fluid that flows out of the pumpbox. Suitable fluid control devices may include one or more valves or any other suitable devices. Any suitable valves may be used as fluid control devices, although in some embodiments of the invention, the one or more valves may be dart valves. In some embodiments of the invention, the one or more valves may simply operate in either a fully open or a fully closed position. However, in a preferred embodiment of the invention, the valves may be operable over a wide range of positions between the fully open and the fully closed positions.

In some embodiments, the level control means may operate by taking measurements (manual, automatic or a combination thereof) of the fluid level within the one or more vessels. Depending on the whether the fluid level is above or below a setpoint value or, alternatively (or in addition to the fluid level measurement), whether the fluid level in the one or more vessels is rising or falling, the level control means may be actuated manually, automatically, or by a combination thereof. For instance, if the fluid level in the one or more vessels is above a setpoint value, the level control means may be actuated to allow fluid to exit the pumpbox or to increase the flowrate of fluid leaving the pumpbox, thereby lowering the level in the one or more vessels. Alternatively, if the fluid level in the one or more vessels is rapidly decreasing, the level control means may be actuated to restrict (or even preclude) the flow of fluid exiting the pumpbox.

Actuation of the level control means may be controlled using any suitable method. For instance, actuation of the level control means may involve the manual actuation of the fluid control devices. Alternatively, the level control means may be associated with an actuator which, open receiving a signal (such as from a distributed control system (DCS) or similar automated control system), may actuate to cause a change in state of the level control means (such as an opening or closing of a valve). In some embodiments of the invention, actuation of the level control means may be controlled by a combination of manual and automatic operation.

In a preferred embodiment of the invention, the classification of the stream entering the pumpbox results in a separation of the stream into two distinct streams: a classified stream and a rejects stream. In some embodiments of the invention, the classification of the stream may also produce a middlings stream.

In preferred embodiments of the invention, at least a portion of the rejects stream may report to a separate part of the circuit or plant for further processing. Alternatively, at least a portion of the rejects stream may report to the plant tailings stream. In a most preferred embodiment, the entire rejects stream leaves the pumpbox for further processing or for disposal to tailings.

The classified stream may be pumped to another part of the circuit or plant for further processing. However, in a preferred embodiment of the invention, at least a portion of the classified stream is recycled to the one or more vessels in fluid communication with the pumpbox.

While it would be preferred that at least a substantial proportion of the classified stream is recycled to the one or more vessels, a skilled addressee will understand that, depending on process conditions, this may not always be possible. For instance, when the fluid level in the one or more vessels is high or increasing, it may be preferred that only a very small portion (or even none) of the classified stream is recycled to the one or more vessels in order to avoid overflowing in the one or more vessels. Thus, in a preferred embodiment of the invention, the pumpbox may be configured in such a manner that at least a portion of the reject stream and at least a portion of the classified stream may be combined.

On the other hand, when the fluid level in the one or more vessels is low or decreasing, it may be possible to recycle the entire classified stream to the one or more vessels. In situations in which the fluid level in the one or more vessels is very low or decreasing at a high rate, it may be desirable to add further fluid to the recycled portion of the classified stream. Similarly, if the portion of the classified stream being recycled has a high percentage of solid particles therein, it may be desirable to dilute the classified stream prior to recycling to the one or more vessels. Thus, in some embodiments of the invention, the pumpbox may be provided with fluid addition means. Any suitable fluid addition means may be used, such as connecting a water line to the pumpbox, either permanently or removably.

Alternatively, it may be desired to provide the pumpbox with means for adding a further slurry stream to be combined with the classified stream for recycling to the one or more vessels. The further slurry stream may be a stream from a different part of the circuit or, in other embodiments of the invention, the further slurry stream may be a fresh feed stream.

In another embodiment of the invention, recycling of the at least a portion of the classified stream may be isolated such that the entire stream entering the pumpbox reports to the rejects stream.

In a further embodiment of the invention, the classification portion of the pumpbox may be isolated such that no classification of the stream entering the pumpbox takes place. In this embodiment of the invention, the stream entering the pumpbox may be entirely recycled to the one or more vessels, may report entirely to the rejects stream, or a combination of the two.

The pumpbox of the present invention may be used in any suitable processing circuit. For instance, the pumpbox may be used in base metals flotation circuits, other metalliferous flotation circuits (for instance, platinum group metal flotation circuits), precious metal flotation circuits, coal flotation circuits, industrial mineral and other valuable mineral flotation circuits and oil sands flotation circuits.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
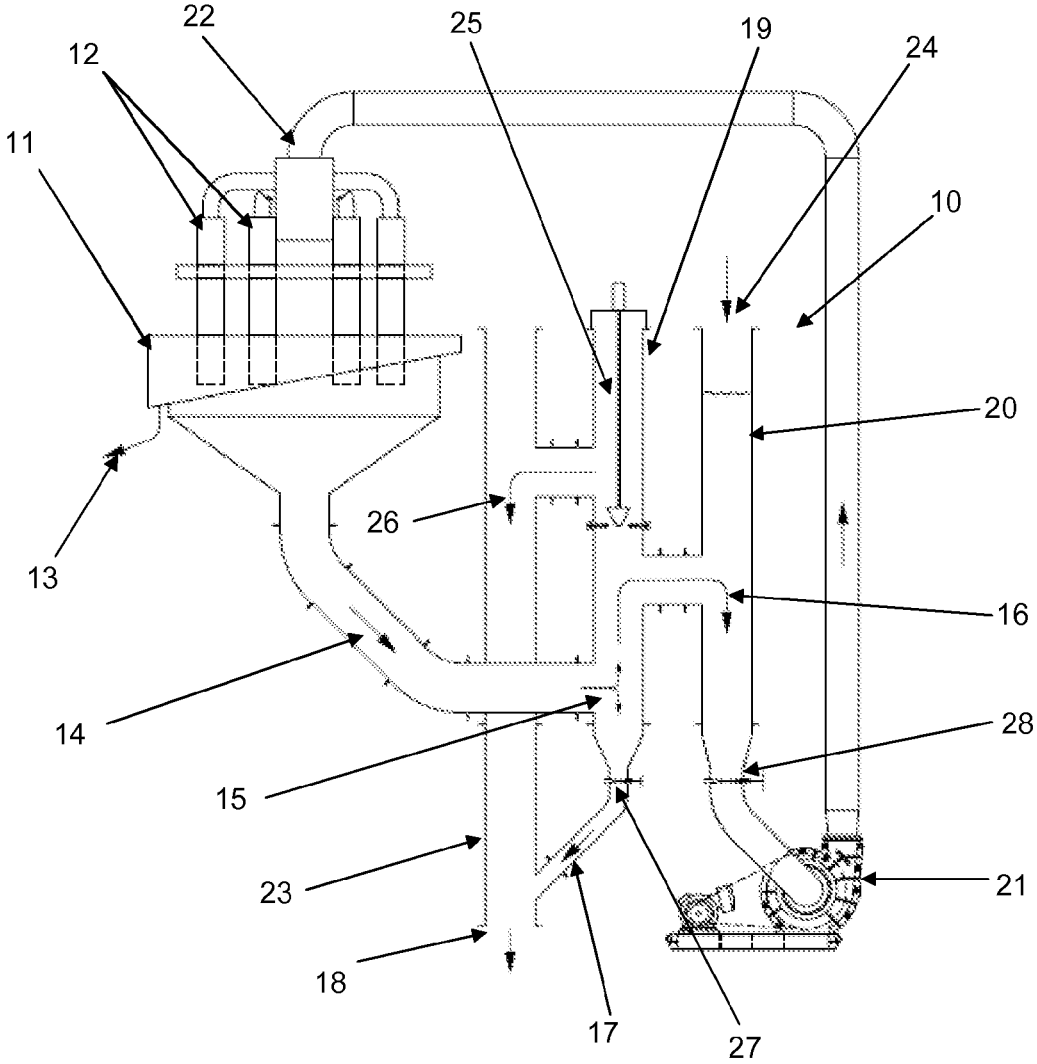
FIG. 1 illustrates a flowsheet including a pumpbox according to an embodiment of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

It will be appreciated that the drawings have been provided for the purposes of illustrating preferred embodiments of the present invention and that the invention should not be considered to be limited solely to the features as shown in the drawings.

In FIG. 1, a flowsheet including a pumpbox 10 according to an embodiment of the present invention is illustrated. The pumpbox 10 is in fluid communication with a flotation cell 11. Feed material enters the flotation cell 11 through the downcomers 12 and is separated into a concentrate stream 13 and a tailings stream 14. The tailings stream 14 flows under gravity to the pumpbox 10.

The tailings stream 14 enters the pumpbox 10 in a first chamber 19 comprising the classification portion 15. In the classification portion 15, the tailings stream 14 is forced to change direction, causing the lighter, finer particles to flow upwards and form the classified stream 16 which flows into a second chamber 20 of the pumpbox 10. The coarser, denser particles lose momentum due to the change of direction of the tailings stream 14 and report to the rejects stream 17. Further, the upflow velocity in classification portion 15 is lower than the settling velocity of the larger or denser particles in the tailings stream and hence the larger or denser particles settle downwardly through the uplowing fluid in the classification section 15. The rejects stream 17 flows into a third chamber 23 of the pumpbox 10, from where it exits the pumpbox 10 through an outlet 18. From here, the rejects stream 17 may be transferred to another part of the circuit for further processing or may be discarded, for instance to a tailings dam.

The classified stream 16 is recycled via pump 21 to the head 22 of the flotation cell 11. The recycled volume of the classified stream 16 is determined by the head differential between the fluid level in the flotation cell 11 and the fluid level in the second chamber 20. The second chamber 20 of the pumpbox 10 is provided with an inlet 24 through which water (to dilute the classified stream 16 for recycling) and/or slurry, such as a fresh feed slurry, (to combine with the classified stream 16 for recycling) may be added.

The first chamber 19 further comprises level control means in the form of a dart valve 25. The dart valve 25 controls the level of fluid in the flotation cell 11, such that, when the dart valve 25 is open (as illustrated in FIG. 1), a portion of the classified stream 16 will flow into the third chamber 23 (shown by arrow 26) and will be combined with the rejects stream 17. Thus, in situations in which the fluid level in the flotation cell 11 is high or rising, the volume of slurry being removed through the dart valve 25 will increase in order to avoid overflowing the cell and reducing the grade of the concentrate stream 13. Alternatively, when the fluid level in the flotation cell 11 is low or decreasing, the dart valve 25 may be closed, thereby reducing the slurry flow through the dart valve 25 and causing all of the classified stream 16 to be recycled to the head 22 of the flotation cell.

The first chamber 19 further comprises a valve 27. It is envisaged that, in normal operation, the valve 27 will be maintained in an open position to allow the flow of the rejects stream 17 therethrough. However, there may be occasions when it is desired that all of the tailings stream 14 entering the pumpbox 10 is recycled to the head 22 of the flotation cell 11. Alternatively, the valve 27 may be closed to allow for maintenance work to be carried out.

Similarly, the second chamber 20 comprises a valve 28 that, under normal operating conditions, would be maintained in an open position to allow the classified stream 16 to be recycled to the head 22 of the flotation cell 11. However, when recycling is not desired, or, for instance, when maintenance of the pump 21 is required, the valve 28 may be closed.

Figure 2:
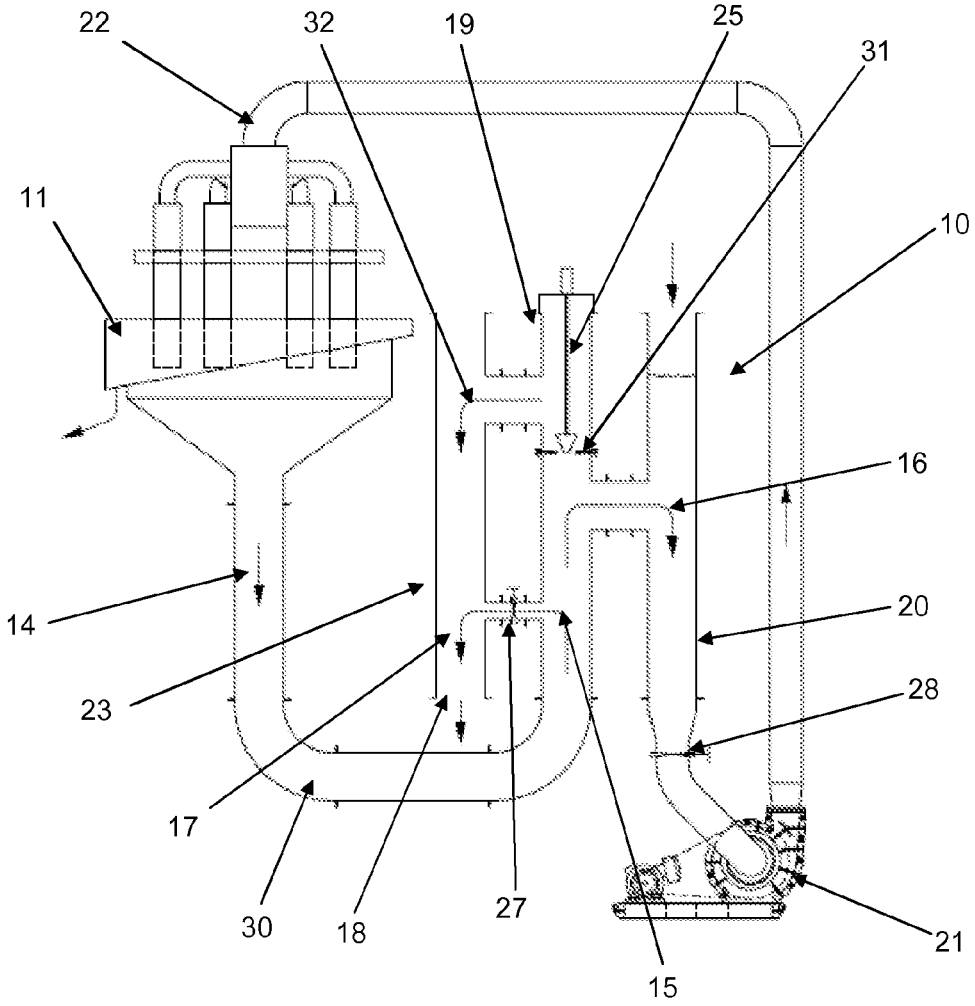
FIG. 2 illustrates a flowsheet including a pumpbox according to an alternative embodiment of the present invention.

In FIG. 2 there is illustrated a flowsheet showing a pumpbox 10 according to an alternative embodiment of the present invention. In this embodiment, the pipe 30 carrying the tailings stream 14 from the flotation cell 11 changes direction as it enters the classification portion 15 in a first chamber 19 of the pumpbox 10. This change of direction causes the coarser, denser particles to drop out of the slurry stream and form the rejects stream 17 which exits the pumpbox 10 through an outlet 18 in the third chamber 23. Further, the upflow velocity in classification portion 15 is lower than the settling velocity of the larger or denser particles in the tailings stream and hence the larger or denser particles settle downwardly through the uplowing fluid in the classification section 15. The classified stream 16 (comprising the finer, lighter particles) flows into the second chamber 20 from where it is recycled via a pump 21 to the head 22 of the flotation cell 11.

The first chamber 19 comprises level control means in the form of a dart valve 25. As with the embodiment illustrated in FIG. 1, closing the dart valve 25 causes the entire classified stream 16 to be recycled to the head 22 of the flotation cell 11, whereas opening the dart valve 25 causes at least some of the classified stream 16 to flow through the dart valve seat 31 and combine with the rejects stream 17 as indicated by arrow 32.

The pumpbox is provided with a valve 27 that, when closed, ensures that none of the tailings stream 14 entering the pumpbox 10 reports to the reject stream 17. Similarly, a second valve 28 is provided so that the pump 21 may be isolated when maintenance is required, or when no recycling of the classified stream 16 is desired.

A skilled addressee will understand that the pumpbox of the present invention provides numerous advantages over the prior art. Firstly, by providing the pumpbox (rather than the flotation cell) with the level control means, the service life of the level control means may be significantly improved.

In addition, the pumpbox of the present invention allows for the preferential removal of coarse particles from the stream entering the pumpbox and the recycling of fine material to the cell. A skilled addressee will understand that recycling of fine material may ultimately result in an increase in recovery of valuable mineral within the flotation cell.

Those skilled in the art will appreciate that the present invention may be susceptible to variations and modifications other than those specifically described. It will be understood that the present invention encompasses all such variations and modifications that fall within its spirit and scope.

While the specific embodiments have been illustrated and described, numerous modifications come to mind without significantly departing from the spirit of the invention, and the scope of protection is only limited by the scope of the accompanying Claims.

What is claimed is:

1. A pumpbox, the pumpbox being in fluid communication with one or more vessels, wherein the pumpbox comprises a classification portion which classifies a stream of fluid entering the classification portion into at least a rejects stream comprising relatively coarse, dense particles and a classified stream comprising relatively fine, light particles and level control means adapted to control the level of fluid within the one or more vessels, and wherein at least a portion of the classified stream is recycled to the one or more vessels.

2. The pumpbox according to claim 1 wherein the pumpbox comprises a plurality of chambers in fluid communication with one another.

3. The pumpbox according to claim 1 wherein the one or more vessels are mixing tanks or settling tanks.

4. The pumpbox according to claim 1 wherein the one or more vessels are flotation cells or banks of flotation cells.

5. The pumpbox according to claim 4 wherein the flotation cells are Jameson cells.

6. The pumpbox according to claim 1 wherein a stream of fluid is fed from the one or more vessels to the pumpbox under gravity.

7. The pumpbox according to claim 1 wherein the level of fluid in the one or more vessels is controlled by the actuation of the level control means.

8. The pumpbox according to claim 1 wherein the level control means comprises one or more valves operable over a wide range of positions between a fully open condition and a fully closed condition.

9. The pumpbox according to claim 8 wherein the one or more valves are dart valves.

10. The pumpbox according to claim 1 wherein actuation of the level control means is in response to a measurement of the level of fluid within the one or more vessels.

11. The pumpbox according to claim 10 wherein if the fluid level in the one or more vessels is above a setpoint or rapidly rising, the level control means are actuated to increase the flowrate of fluid leaving the pumpbox.

12. The pumpbox according to claim 10 wherein if the fluid level in the one or more vessels is below a setpoint or rapidly decreasing, the level control means are actuated to restrict the flow of fluid leaving the pumpbox.

13. The pumpbox according to claim 1 wherein the level control means are associated with an actuator which, upon receiving a signal, actuates to cause a change in state of the level control means.

14. The pumpbox according to claim 1 wherein the stream of fluid entering the classification portion is further classified into a middlings stream.

15. The pumpbox according to claim 14 wherein the rejects stream leaves the pumpbox for further processing or for disposal to tailings.

16. The pumpbox according to claim 1 wherein the portion of the classified stream recycled to the one or more vessels is combined with a further slurry stream.

17. The pumpbox according to claim 1 wherein the pumpbox is adapted for use in base metals flotation circuits, other metalliferous flotation circuits, precious metal flotation circuits, coal flotation circuits, industrial mineral and other valuable mineral flotation circuits and oil sands flotation circuits.

* * * * *